United States Patent [19]

Ahlf et al.

[11] Patent Number: 4,459,720

[45] Date of Patent: Jul. 17, 1984

[54] SUCTION NOZZLE UNIT

[75] Inventors: Heinz-Jürgen Ahlf, Bergisch Gladbach; Wieland Gühne, Remscheid, both of Fed. Rep. of Germany; Bernd Fink, deceased, late of Wuppertal, Fed. Rep. of Germany, by Martina Fink, heiress

[73] Assignee: Vorwerk & Co Interholding GmbH, Wuppertal, Fed. Rep. of Germany

[21] Appl. No.: 338,567

[22] Filed: Jan. 11, 1982

[30] Foreign Application Priority Data

Jan. 14, 1981 [DE] Fed. Rep. of Germany ..... 3100841

[51] Int. Cl.[3] ..... A47L 9/06

[52] U.S. Cl. ..... 15/398; 15/416

[58] Field of Search ..... 15/398, 416

[56] References Cited

U.S. PATENT DOCUMENTS

| | | | |
|---|---|---|---|
| 2,180,694 | 11/1939 | Reed | 15/416 UX |
| 2,348,861 | 5/1944 | Smellie | 15/416 UX |
| 3,750,222 | 8/1973 | Johnson | 15/416 |
| 4,223,419 | 9/1980 | Sato et al. | 15/405 X |
| 4,332,051 | 6/1982 | LaMonte | 15/416 X |

FOREIGN PATENT DOCUMENTS

| | | | |
|---|---|---|---|
| 1173623 | 7/1964 | Fed. Rep. of Germany | 15/416 |
| 2053055 | 5/1972 | Fed. Rep. of Germany | 15/416 |

*Primary Examiner*—Chris K. Moore

*Attorney, Agent, or Firm*—Michael J. Striker

[57] ABSTRACT

A suction nozzle unit for selectively aspirating dust from flat surfaces and from joints or edges has a connecting suction member, a body part connected with the latter and having two separate air passages provided with different cross-sections and forming a joint nozzle and a surface nozzle, and a switching element alternatingly communicating each of the passages with the connecting suction member to actuate a respective one of the nozzles. The connecting suction member is rotatably connected with the body part, and the surface nozzle is provided with a bristle-containing member.

7 Claims, 3 Drawing Figures

SUCTION NOZZLE UNIT

BACKGROUND OF THE INVENTION

The present invention relates to a suction nozzle unit for selectively aspirating dust from flat surfaces and joints or edges.

Suction nozzle units of the above mentioned general type are known in the art. A known suction nozzle unit has a body part with two separate air passages of different cross sections, wherein the body part is arranged on a connecting suction member communicating with a suction conduit, and the air passages can alternately communicate with the connecting suction member. Such a suction nozzle is disclosed, for example, in the German Offenlegungsschrift No. 2,052,606. The suction nozzle unit disclosed in this reference has a body part provided on a rigid immovable connecting suction member, wherein the body part carries a bristle containing member and has an air communication to the connecting suction member. Moreover, a so-called joint nozzle is rotatably arranged on the body part. The joint nozzle is located, with its part fixedly connected thereto, between the body part and the connecting suction member in such a manner that during rotation of the joint nozzle forwardly to working position a portion of the communication between the body part and the connecting suction member is closed and the suction stream is turned toward the joint nozzle. The above described construction possesses several disadvantages during its use. It is very disadvantageous that, during exchange of the nozzle type, the joint nozzle must be always rotated forwardly or rearwardly. When it is located rearwardly, it makes difficult the handling inasmuch as it projects from the housing and is located in the gripping region. It is also disadvantage that, because of the part rotatable with the joint nozzle for closing, the dimensions must be held very accurate so as to guarantee a reliable sealing and thereby joining of the air paths. It is also a disadvantage that the rigid immovable connecting suction member assumes, during different work with the joint nozzle, such an angle which requires from the user to have a position of his hand causing fatigue.

SUMMARY OF THE INVENTION

Accordingly, it is an object of the present invention to provide a suction nozzle unit which avoids the disadvantages of the prior art.

More particularly, it is an object of the present invention to provide a suction nozzle unit which makes simpler the use of different nozzle types and at the same time makes easier the handling of the entire unit.

In keeping with these objects, and with others which will become apparent hereinafter, one feature of the present invention resides, briefly stated, in a suction nozzle unit which has a connecting suction member, a body part connected with the connecting suction member and having two separate air passages of different cross sections, wherein one of the passages forms a joint nozzle suitable for aspirating dust from joints and edges, and the other of the passages forms a surface nozzle suitable for aspirating dust from flat surfaces, and means is provided for alternately communicating each of the passages of the body part with the connecting suction member so as to actuate a respective one of the nozzles.

When the suction nozzle unit is designed in accordance with the present invention, the user can work with such a suction nozzle unit faster and simpler. Moreover, sealing of the switching part is simpler.

In accordance with another feature of the present invention, a bristle-containing member is detachably mounted on the body part in the region of the surface nozzle.

Still another feature of the present invention is that the connecting conduit member is rotatably connected with the body part so that they can turn relative to one another.

In accordance with a further feature of the present invention, the body part is formed to define two passages and is formed as a one-piece member rotatably connected with the connecting suction member.

According to a further feature of the present invention, the communicating means includes a switch flap movable between two positions in which it closes and opens a respective one of the passages in the body part.

Finally, the passages or more particularly their inlets are arranged so that they aspirate dust in two directions, one of which corresponds to the axial direction of the connecting conduit member, whereas the other is transverse to the latter.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
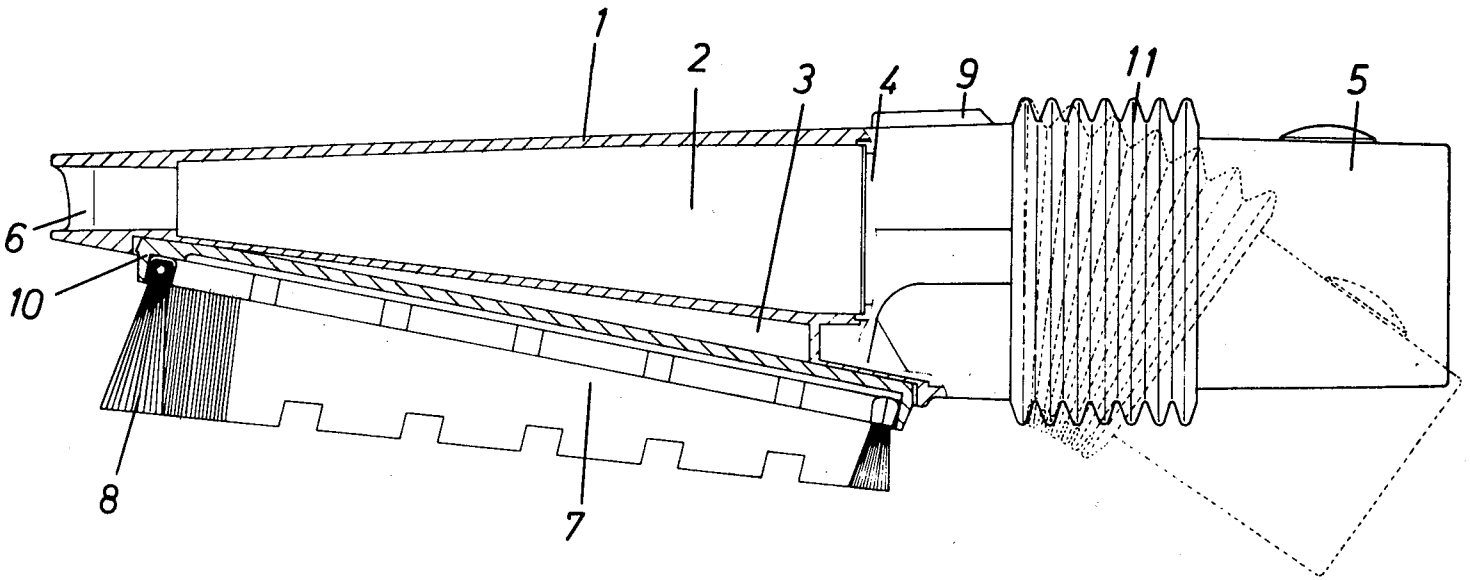
FIG. 1 is a side view showing a suction nozzle unit in accordance with the present invention.
Figure 2:
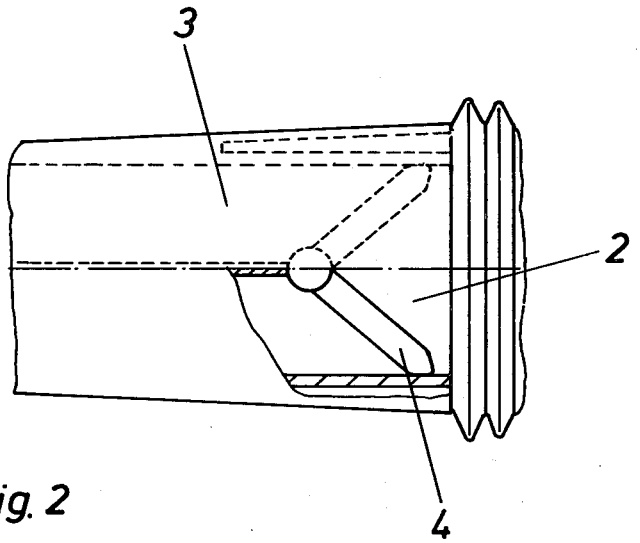
FIG. 2 is a plan view of a fragment of the inventive suction nozzle unit, partially suctioned.
Figure 3:
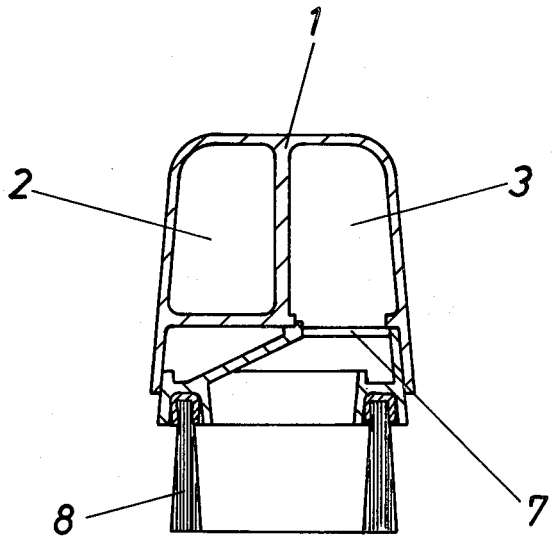
FIG. 3 is a view showing a vertical suction of the inventive suction nozzle unit of FIG. 1.

A suction nozzle unit in accordance with the present invention has a body part which is identified by reference numeral 1.

The body part is provided with two separate air passages 2 and 3. The air passage 2 of the body part 1 leads to a so-called joint nozzle 6. The air passage 3 of the body part 1 leads to a so-called surface nozzle 7. The air passage 3 is directed, as considered in the plane of FIG. 1 of the drawing, behind the air passage 2 to a switching flap 4.

The switching flap 4, which is sectioned here, is formed as a conventional turning flap and alternately opens either the air passage 2 or the air passage 3. The switch flap 4 is actuated by a lever 9 so as to assume the respective positions for opening a respective one of the passages 2 and 3.

A bristle ring 8 is arranged in the surface nozzle 7, or more particularly, in the housing region corresponding to the surface nozzle 7. The bristle ring 8 is mounted on a plate 10 which can be removed from the surface nozzle 7.

A connecting suction pipe 5 is rotatably arranged on the body part 1 to make easier the handling of the suction nozzle unit. The connecting suction pipe 5 is shown in the drawings in two positions shown in solid lines and broken lines, respectively. For sealing the rotary connection between the connecting suction member 5 and the body part 1, a bellows 11 is provided therebetween.

As can be seen from the drawing, the body part 1 is a one-piece member which simultaneously forms the two above mentioned passages 2 and 3. The passages 2 and 3, or more particularly their inlets which form the nozzles 6 and 7, extend in different directions. More particularly, they extend in a direction corresponding to the axis of the connecting suction pipe 5 and in a direction which is substantially normal or transverse to the axis of the connecting suction pipe 5, respectively.

It will be understood that each of the elements described above, or two or more together, may also find a useful application in other types of constructions differing from the types described above.

While the invention has been illustrated and described as embodied in a suction nozzle unit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A suction nozzle unit for selectively aspirating dust from flat surfaces and from joints or edges, comprising a connecting suction member having an axis; an elongated body part connected with said connecting suction member and forming two separate air passages having different cross sections and both extending in a direction of elongation of said body part; a joint nozzle suitable for aspirating dust from joints and edges and connected with one of said passages; a surface nozzle suitable for aspirating dust from flat surfaces and connected with the other of said passages; and means for alternatively communicating each of said passages with said connecting suction member so as to actuate a respective one of said nozzles, said nozzles being connected with said air passages so that through said joint nozzle air is aspirated in a direction of said axis of said suction member part, whereas through said surface nozzle air is aspirated in a direction which is substantially normal to the direction of said axis of said suction member.

2. A suction nozzle unit as defined in claim 1, wherein said communicating means includes a switch flap movable between at least two positions in which it closes and opens a respective one of said passages.

3. A suction nozzle unit as defined in claim 1; and further comprising a bristle-containing member detachably mounted on said body part in the region of said surface nozzle.

4. A suction nozzle unit as defined in claim 1, wherein said connecting suction member is rotatably connected with said body part so that the latter and the former can turn relative to one another.

5. A suction nozzle unit as defined in claim 1, wherein said body part which forms said two passages is a one-piece member.

6. A suction nozzle unit for selectively aspirating dust from flat surfaces and from joints or edges, comprising a connecting suction member; an elongated body part connected with said connecting suction member and forming two separate air passages having different cross sections and both extending in a direction of elongation of said body part, a joint nozzle suitable for aspirating dust from joints ane edges and connected with one of said passages; a surface nozzle suitable for aspirating dust from flat surfaces and connected with the other of said passages; and means for alternatively communicating each of said passages with said connecting suction member so as to actuate a respective one of said nozzles, said nozzles being connected with said air passages so that through said joint nozzle air is aspirated in the direction of elongation of said body part, whereas through said surface nozzle air is aspirated in a direction which is substantially normal to the direction of elongation of said body part.

7. A suction nozzle unit for selectively aspirating dust from flat surfaces and from joints or edges, comprising a connecting suction member; an elongated body part connected with said connecting suction member and forming two separate air passages having different cross sections and both extending in a direction of elongation of said body part, said body part having an outlet portion which is connected with said suction member and has an axis; a joint nozzle suitable for aspirating dust from joints and edges and connected with one of said passages; a surface nozzle suitable for aspirating dust from flat surfaces and connected with the other of said passages; and means for alternatively communicating each of said passages with said connecting suction member so as to actuate a respective one of said nozzles, said nozzles being connected with said air passages so that through said joint nozzle air is aspirated in a direction of said axis of said outlet portion of said body part, whereas through said surface nozzle air is aspirated in a direction which is substantially normal to the direction of said axis of said outlet portion of said body part.

* * * * *